US012405076B2

(12) United States Patent
Jurga

(10) Patent No.: US 12,405,076 B2
(45) Date of Patent: Sep. 2, 2025

(54) UNIT FOR LOADING AMMUNITION INTO BOX MAGAZINES OF SMALL ARMS

(71) Applicant: Mariusz Jurga, Poznań (PL)

(72) Inventor: Mariusz Jurga, Poznań (PL)

( * ) Notice: Subject to any disclaimer, the term of this patent is extended or adjusted under 35 U.S.C. 154(b) by 0 days.

(21) Appl. No.: 18/839,275

(22) PCT Filed: Jan. 24, 2023

(86) PCT No.: PCT/PL2023/000004

§ 371 (c)(1),
(2) Date: Aug. 16, 2024

(87) PCT Pub. No.: WO2023/158326

PCT Pub. Date: Aug. 24, 2023

(65) Prior Publication Data

US 2025/0164202 A1 May 22, 2025

(30) Foreign Application Priority Data

Feb. 21, 2022 (PL) ..... 440429

(51) Int. Cl.
*F41A 9/83* (2006.01)

(52) U.S. Cl.
CPC ..... *F41A 9/83* (2013.01)

(58) Field of Classification Search
CPC ..... F41A 9/83
See application file for complete search history.

(56) References Cited

U.S. PATENT DOCUMENTS

| | | | | |
|---|---|---|---|---|
| 4,688,344 | A * | 8/1987 | Kim | F41A 9/83 42/88 |
| 9,303,934 | B1 * | 4/2016 | Kazsuk | F41A 9/83 |
| 10,480,877 | B1 * | 11/2019 | Myers | F41A 9/67 |
| 2012/0030987 | A1 | 2/2012 | Lee | |
| 2020/0064093 | A1 * | 2/2020 | Wilkinson | F41A 9/83 |

FOREIGN PATENT DOCUMENTS

EP 2857906 A1 4/2015

OTHER PUBLICATIONS

International Search Report for corresponding PCT/PL2023/000004 dated May 26, 2023.
Written Opinion of the International Searching Authority for corresponding PCT/PL2023/000004 dated May 26, 2023.

* cited by examiner

*Primary Examiner* — J. Woodrow Eldred
(74) *Attorney, Agent, or Firm* — Egbert, McDaniel & Swartz, PLLC

(57) ABSTRACT

Disclosed is a unit for loading ammunition into box magazines of small arms, applicable for quick replenishment, with ammunition, of magazines of small arms equipped with a replaceable box magazine.

34 Claims, 17 Drawing Sheets

Figures 1, 1A, 1B, 1C:
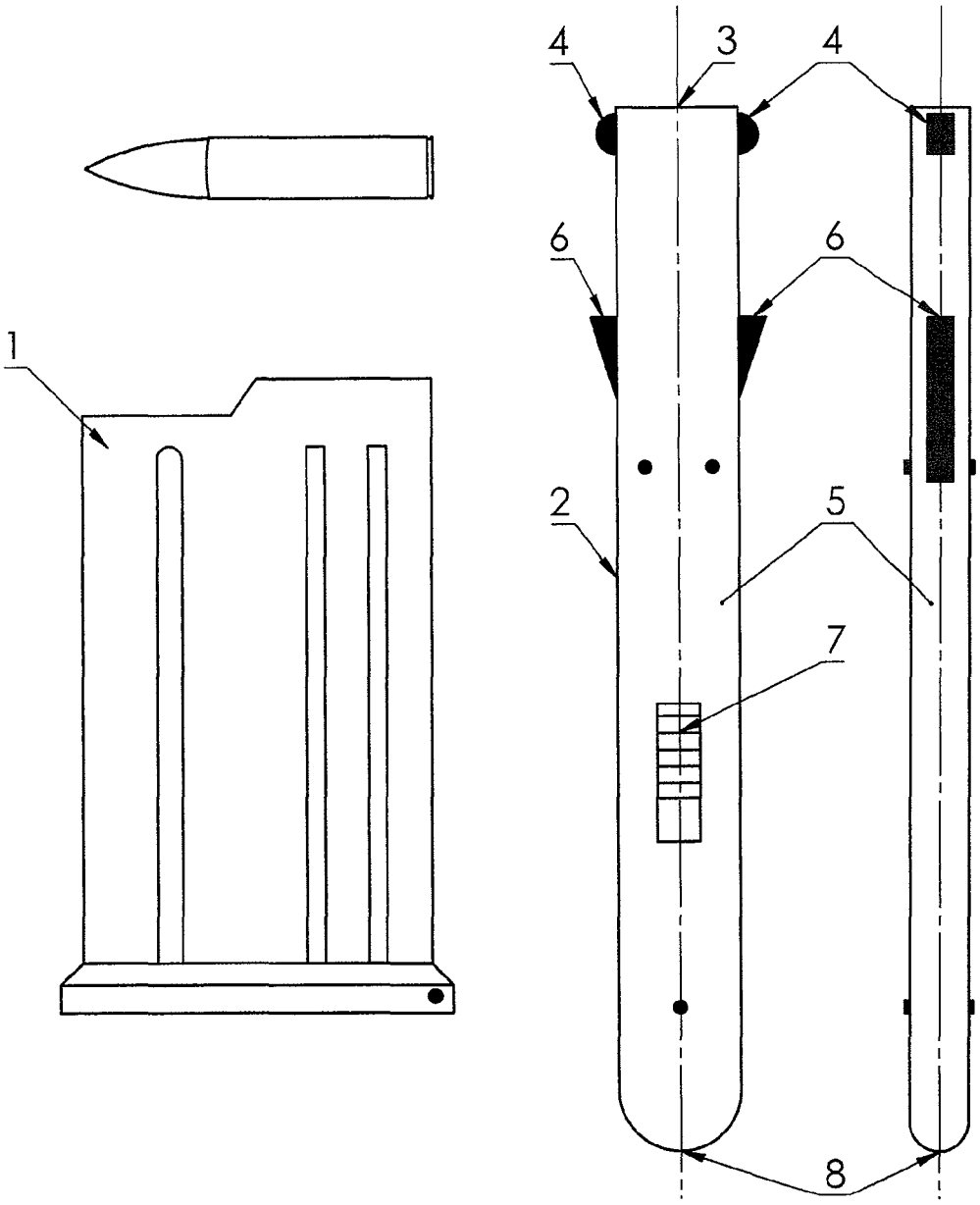

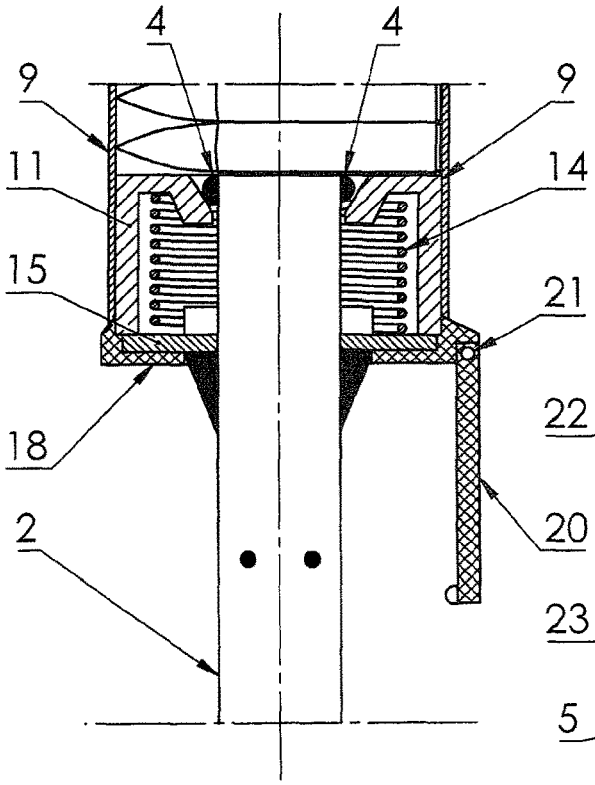
Fig. 7A
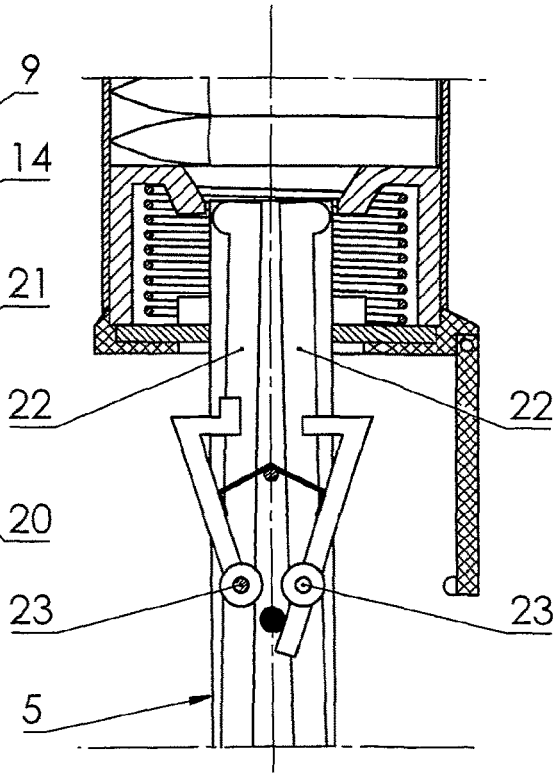
Fig. 7B
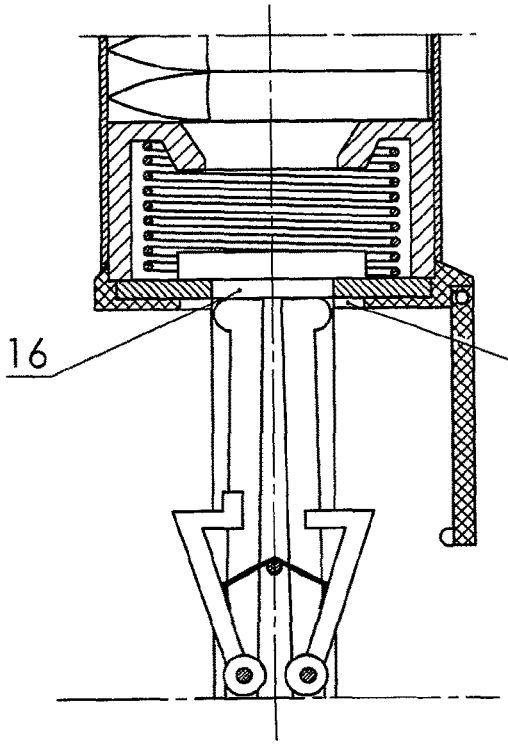
Fig. 7C
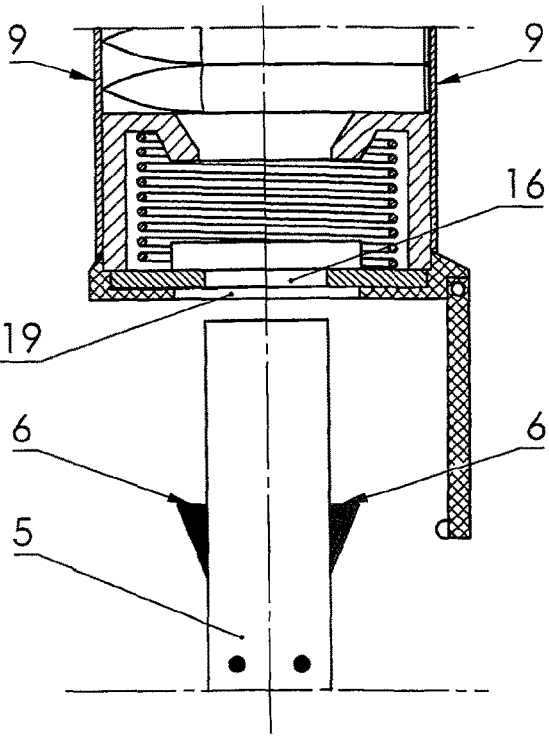
Fig. 7 D
Fig. 7

Fig. 26
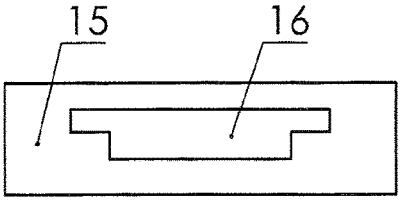
Fig. 27
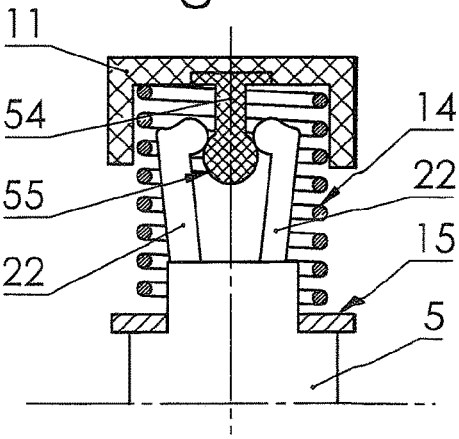
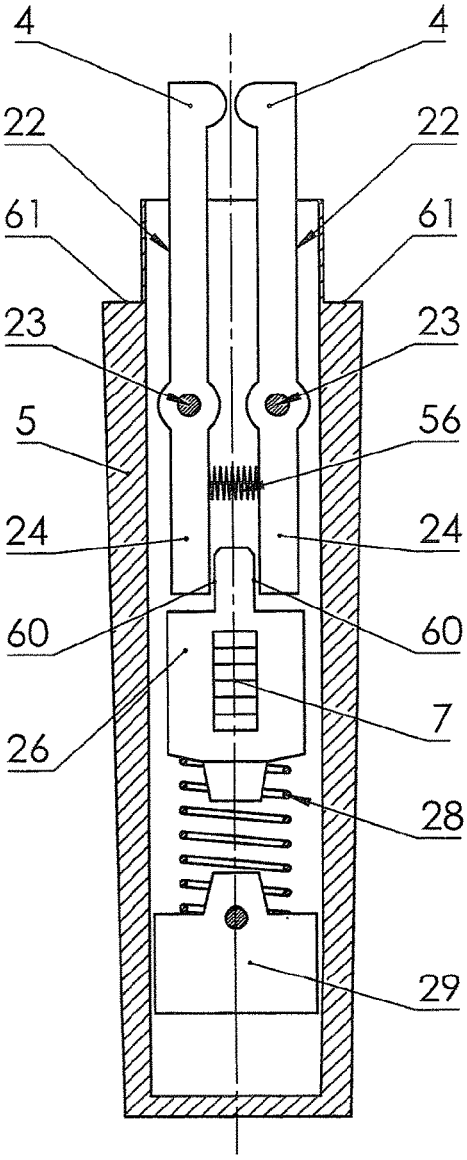
Fig. 24
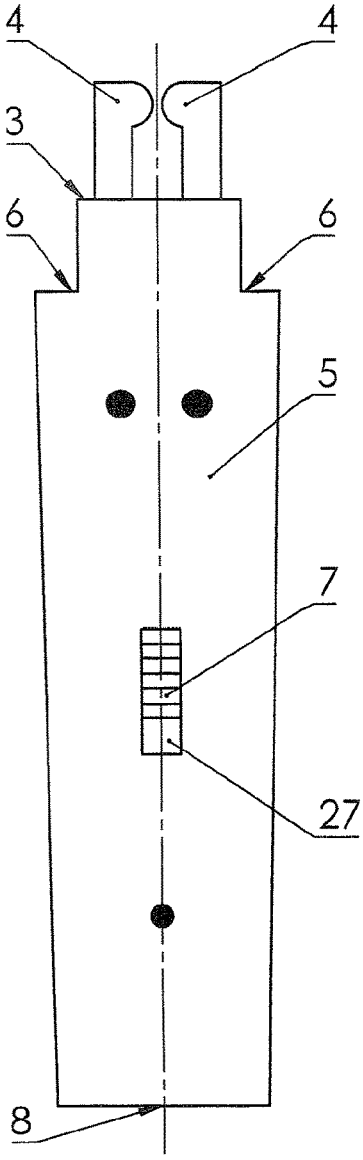
Fig. 25

Fig. 30
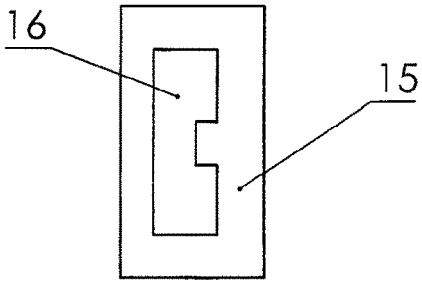
Fig. 31
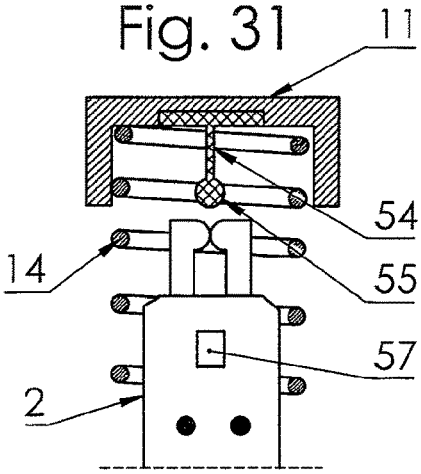
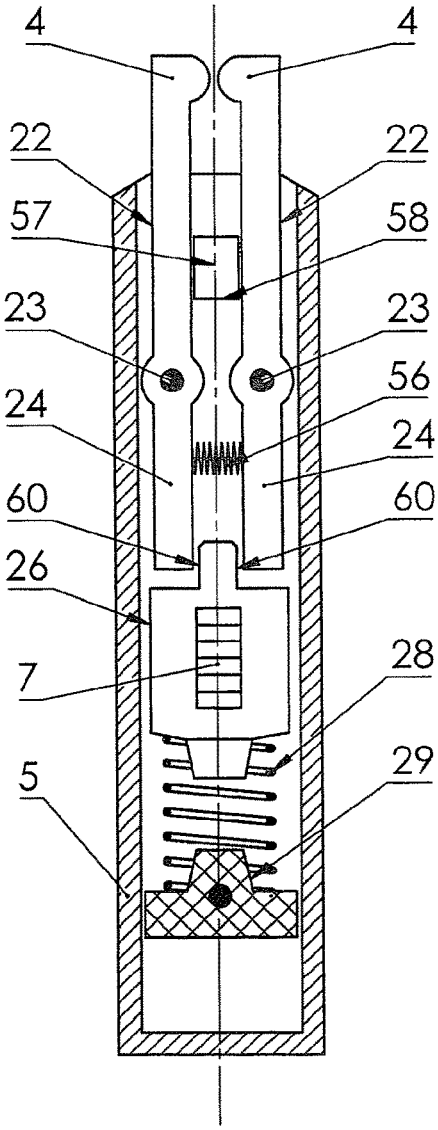
Fig. 28
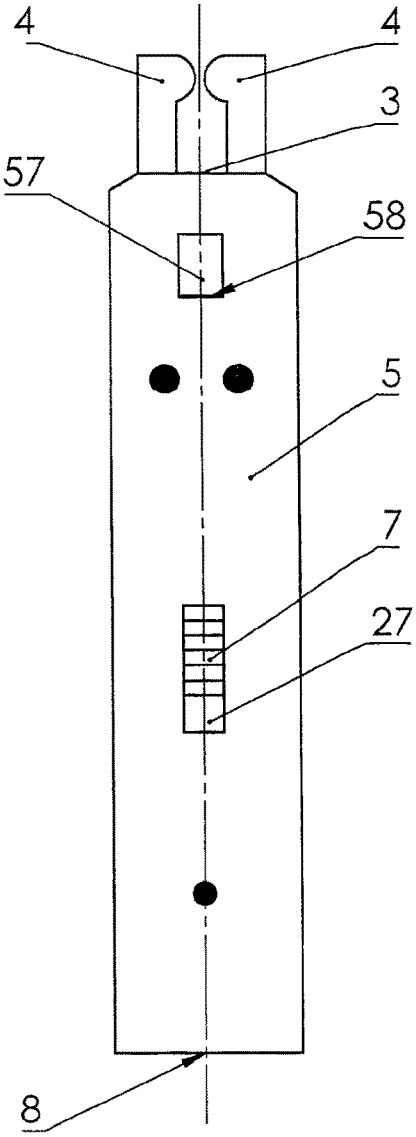
Fig. 29

UNIT FOR LOADING AMMUNITION INTO BOX MAGAZINES OF SMALL ARMS

The object of the invention is a unit for loading ammunition into box magazines of small arms, applicable for quick replenishment, with ammunition, of magazines of small arms equipped with a replaceable box magazine.

During combat operations, it is necessary to replenish the magazine with a number of cartridges after the cartridges placed therein are exhausted. In action, this is done by replacing the empty magazine with a magazine containing a set of cartridges. Empty magazines should be replenished between fights in the shortest possible time and with minimal resources. In order to shorten this time and facilitate loading, the follower should be pulled to the bottom zone of the magazine, which will facilitate the insertion of cartridges inside the magazine box.

There are known units to facilitate the loading of ammunition into the magazine.

The unit shown in patent specification EP 2857906 A1 has a pull rod which is permanently attached on one side to the undersurface of the cartridge follower and has a handle on the other side. The pull rod moves through the hole in the bottom cover of the magazine and through this movement it is possible to pull the follower towards the bottom zone of the magazine and compress the follower spring.

The unit shown in patent specification US 2012/0030987 has a pull rod which ends with a hook bend on one side and a handle on the other side. The pull rod is inserted through the hole in the bottom cover of the magazine and is hooked, with the hook located at its end, to a hole or lug in the follower. Once hooked, it is possible to pull the follower towards the bottom zone of the magazine and compress the follower spring to facilitate loading of ammunition.

The solution being the object of patent specification U.S. Pat. No. 4,688,344 has, on the underside of the cartridge follower, a permanently attached tension rod, ending with a handle outside the magazine, which tension rod moves the cartridge follower into the bottom zone of the magazine while compressing the follower spring.

Also the solution shown in patent specification U.S. Pat. No. 9,303,934 BI has a pull rod, located in the hole of the base cover of the magazine, which ends on the outside with a catch and on the inside of the magazine with an external thread for screwing into the threaded hole of the cartridge follower plate.

The aim of the invention is to develop a unit that ensures fast easy and reliable loading of box magazines of small arms.

The essence of the invention which is a unit for loading ammunition into small arm box magazines which is constituted by a pull-rod device and a magazine having a housing with an upper slot for moving ammunition below which a follower with a centrally located hole is located, wherein the follower is seated on a spring which rests with its lower end on a bottom plate having a centrally located hole and rests on a base cover having a central hole, consists in that the rigid pull-rod device, slidable into the housing, is located in the holes of the follower, the bottom plate and the base cover and has movable catch protrusions preferably located in the zone of the upper extremity of the body, protruding beyond the body outline, detachably connected to the follower surface, closing the follower spring from above and controlled by a slider operated by a spring, the seat of which is located inside the body, and retention protrusions located below the catch protrusions in the zone of the upper extremity of the body, wherein the retention protrusions, after compression of the follower spring, are retained by a movable element blocking the coils of the follower spring from below, thereby they close the compressed follower spring from below and co-create a particularly preferable coupling mechanism that moves along the longitudinal axis of the magazine, and the height of the compressed follower spring when it is moved is an approximately constant value, whereby the follower, the follower spring, the movable element blocking the coils of the follower spring from below and the pull-rod device constitute the coupling mechanism.

It is preferable if the movable element blocking the coils of the follower spring from below is the bottom plate, or the extreme, lowest coil of the follower spring, or an element permanently connected to the follower spring.

It is also preferable if the catch protrusions, closing the follower spring from above, are in the form of double-arm levers seated on axes in the body of the pull-rod device, and the lower arms of the double-arm levers of the catch protrusions are located in a shaped retaining recess of the upper edge of the slider, with the outline of the retaining recess having a shape similar to the letter "U" or to the letter "V". Besides, it is preferable if the retention protrusions are in the form of single-arm levers, fixed on axes in the body of the pull-rod device, or are in the form of double-arm levers, fixed on axes in the body of the pull-rod device, and the levers of the retention protrusions have an expanding spring.

It is also preferable if the catch protrusions are in the form of single-arm levers, fixed on axes in the body of the pull-rod device, while the retention protrusions are in the form of a fiat spring, fixed in the body of the pull-rod device, or a torsion spring, fixed in the body of the pull-rod device. It is also preferable if the retention protrusions are in the form of a latching mechanism, moving slidably along guides in the body of the pull-rod device. Besides, it is preferable if the catch protrusions are in the form of discs with rotation axes located in upper guides of the pull-rod device body, and the retention protrusions are in the form of discs with rotation axes located in lower guides of the pull-rod device body, and a slider of the retention protrusion has a blocking device.

Furthermore, it is preferable if the catch protrusions are in the form of steel balls resting on the upper surface of the inner ring of the pull-rod device body, wherein the pull-rod device body has a circular cross-section, and the retention protrusions are in the form of a thread located on the outer surface of the pull-rod device in its upper zone, and the slider is connected to the body through a threaded connection located inside the pull-rod device body, it is particularly preferable if the bottom plate has a threaded hole for connection to the thread located on the outer surface of the pull-rod device.

It is also preferable if the retention protrusions are in the form of opposite arms, permanently connected to the body of a rotary sleeve that rotates on the outer surface of the pull-rod device.

In addition, it is preferable if the retention protrusions are in the form of symmetrical, stationary surfaces that are transversely positioned with respect to the longitudinal axis of the body and permanently connected to the pull-rod device body, and the lower arms of the double-arm levers of the catch protrusions are retained by the lateral surface of the slider, while the follower has, on its lower surface, a pin terminated with a spherical surface for latching connection to the catch protrusions, and the bottom plate of the magazine has a hole with an outline similar to the letter "T". It is particularly preferable if there is a hole in the upper zone of the pull-rod device body, the lower edge of said hole constituting a lower barrier of the pull-rod device for connection to the bottom plate, while the lower arms of the double-arm catch levers have an expanding spring, and the bottom plate has a hole with an outline similar to the letter "C".

It is also preferable if the slider has a control button that moves in a cut-out of the body.

It is also preferable if the bottom plate of the magazine has vertical stabilizing planes located opposite each other, between which the hole of the bottom plate is located, and the hole of the base cover of the magazine is closed by a swinging plate seated on a rotation axis.

With the use of the solution according to the invention, the unit forms a functional whole that allows the process of loading ammunition to be facilitated and considerably accelerated, and in the absence of the pull-rod device, the modified magazine can be loaded manually in a hitherto known manner.

Figures 2, 2B, 2C:
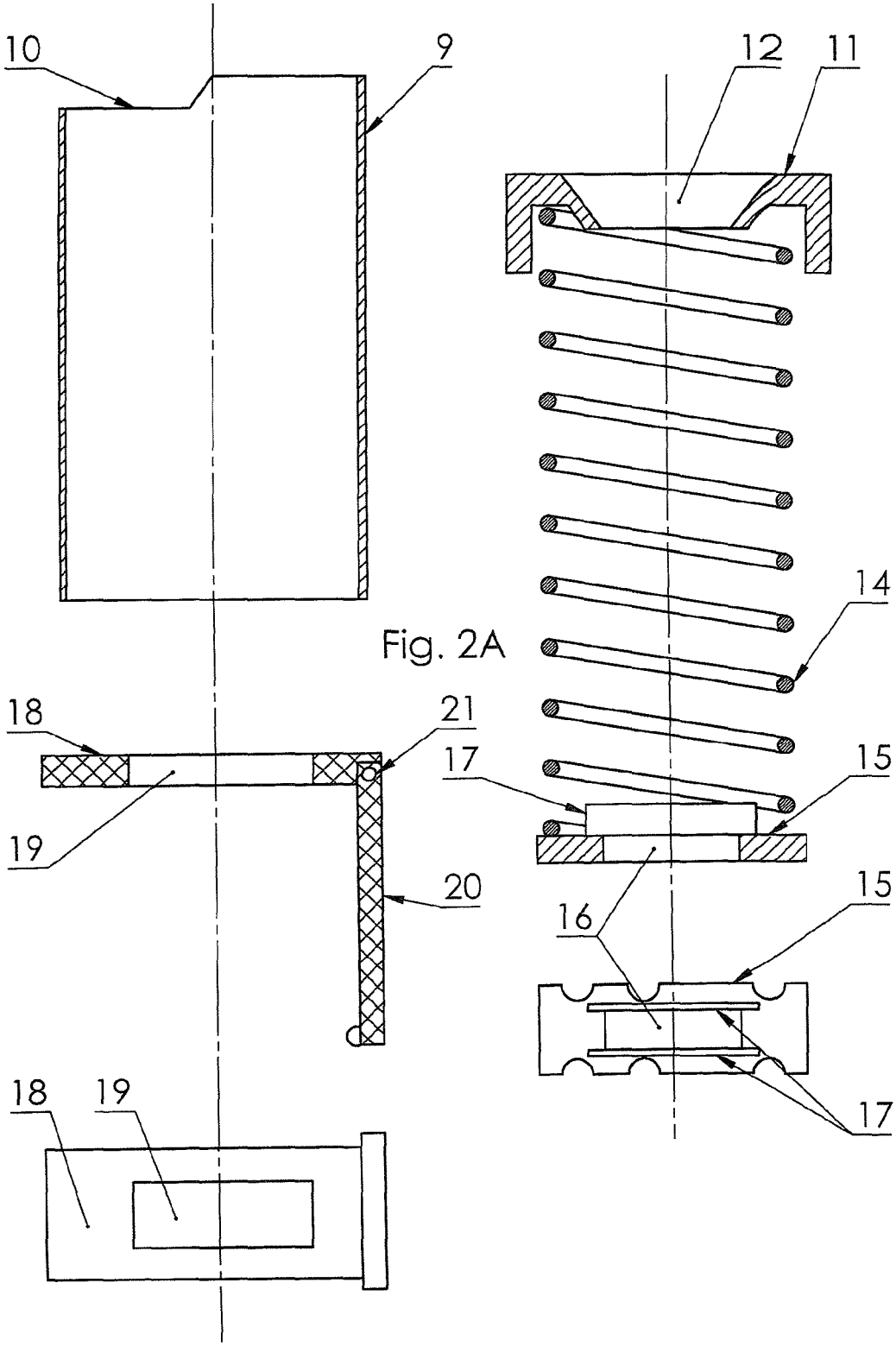
Figure 3:
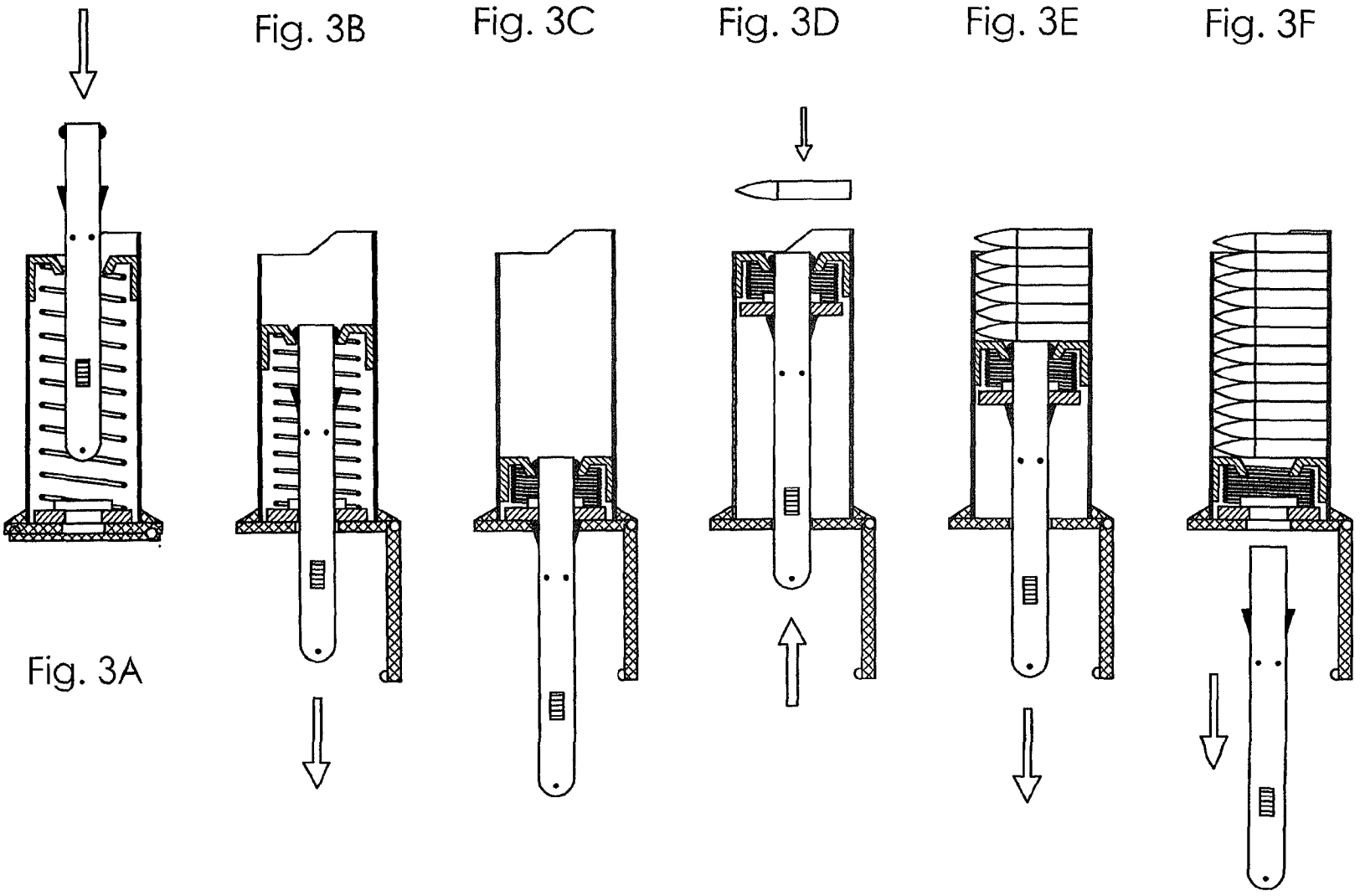
Figure 4:
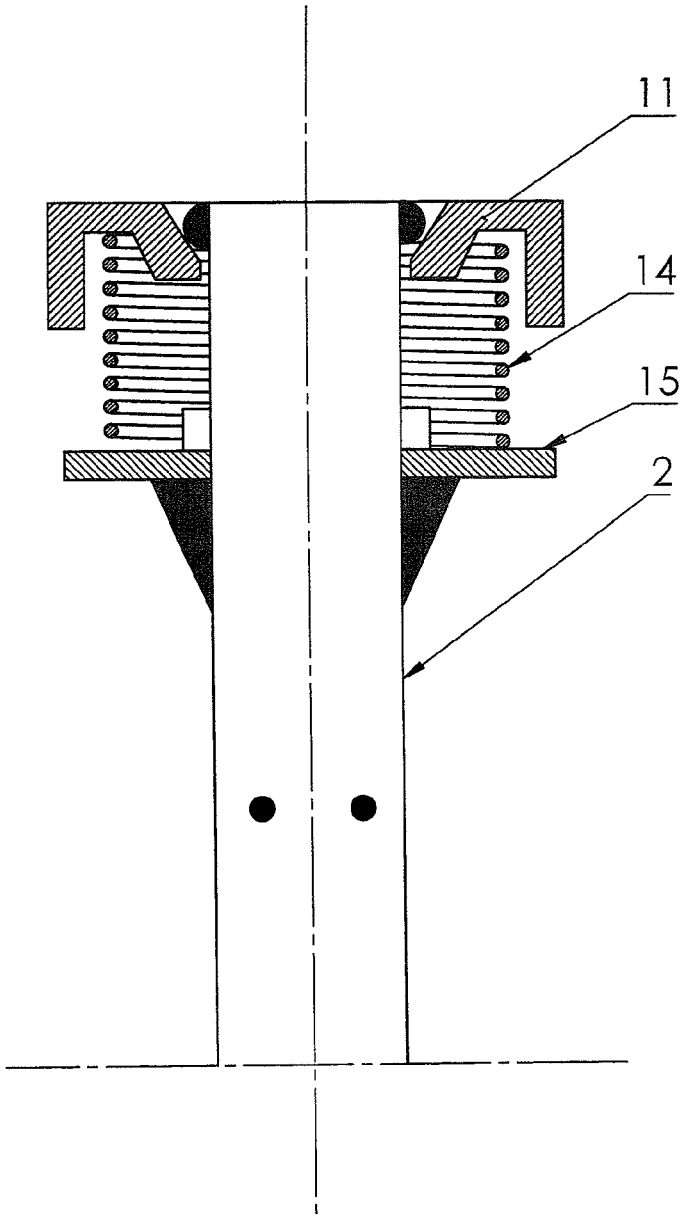
Figure 5:
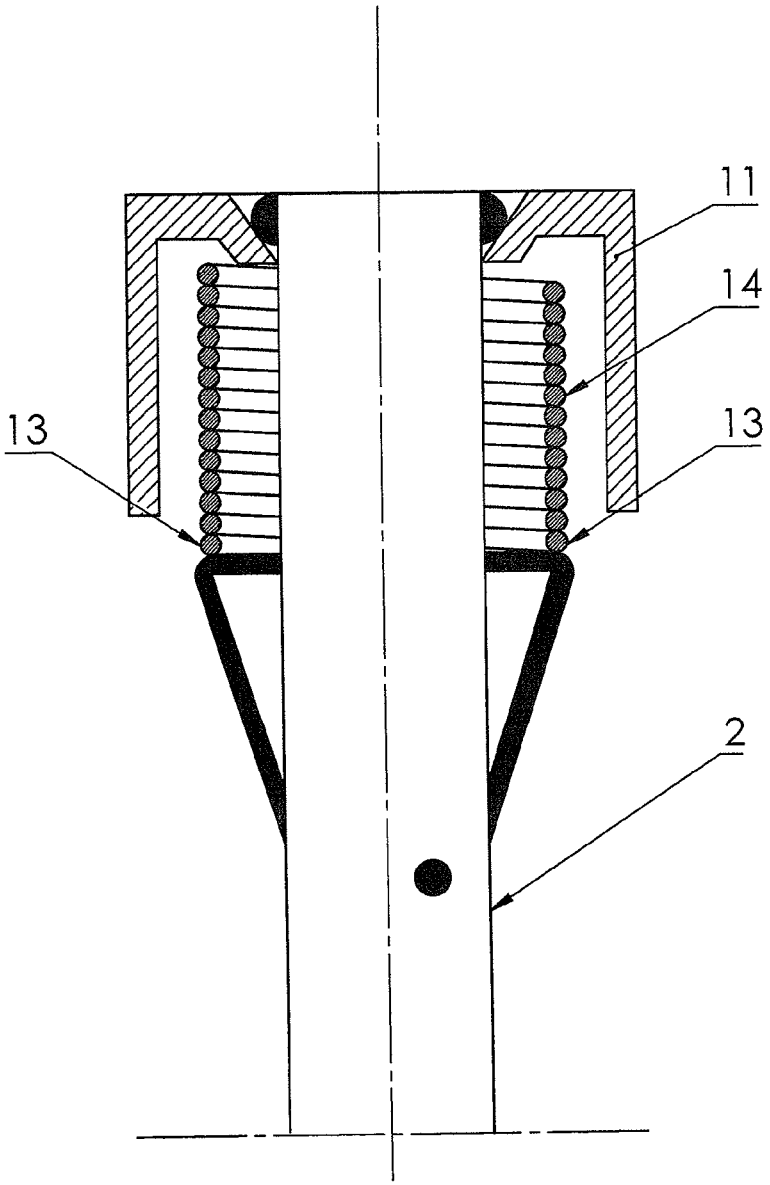
Figure 6:
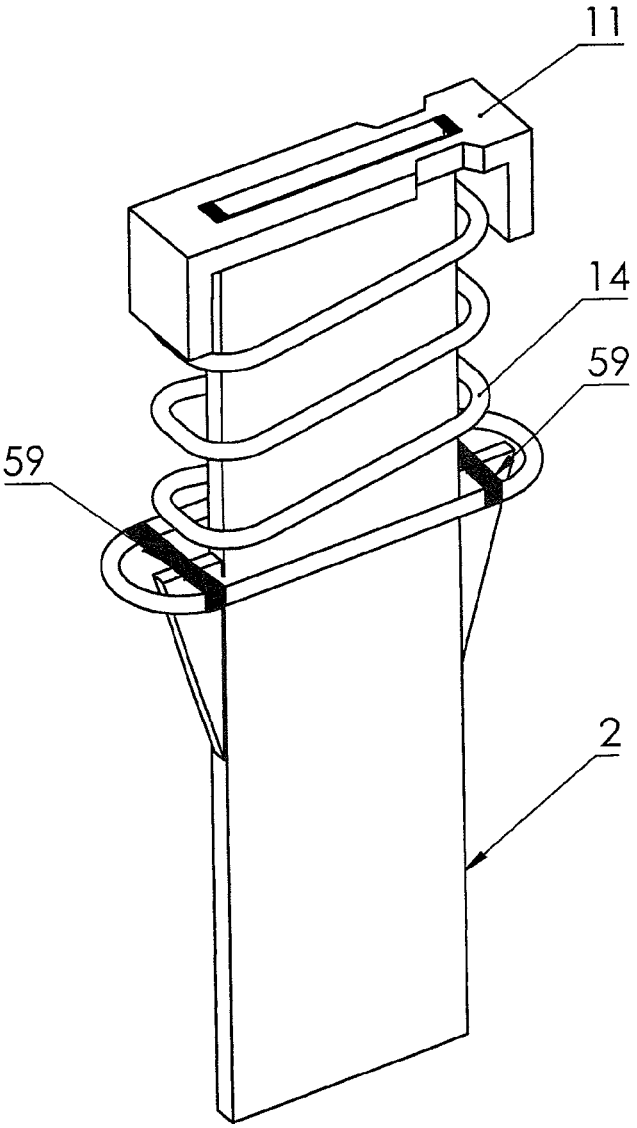
Figure 8:
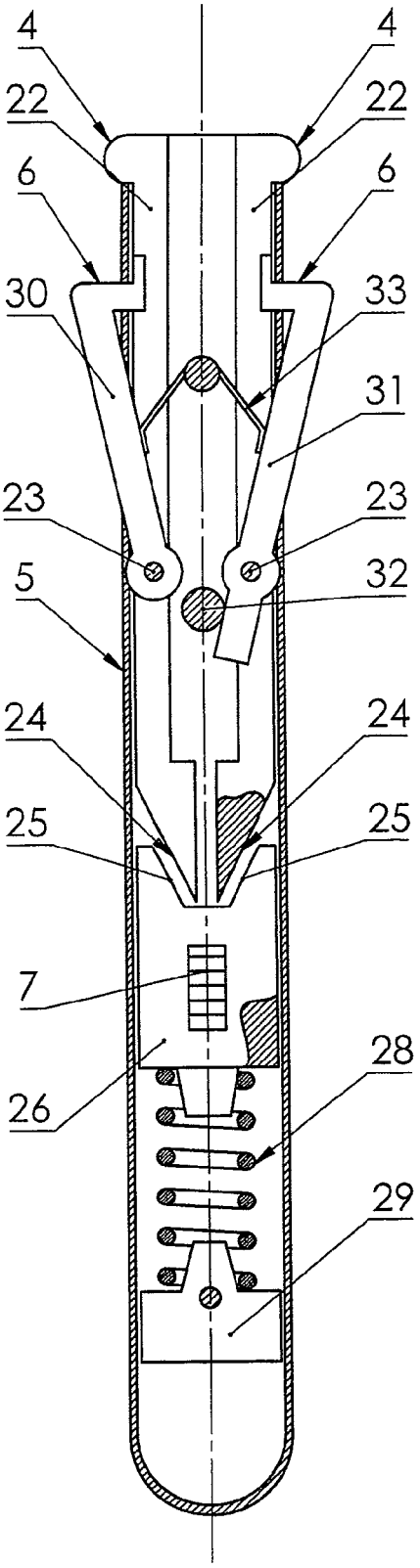
Figure 9:
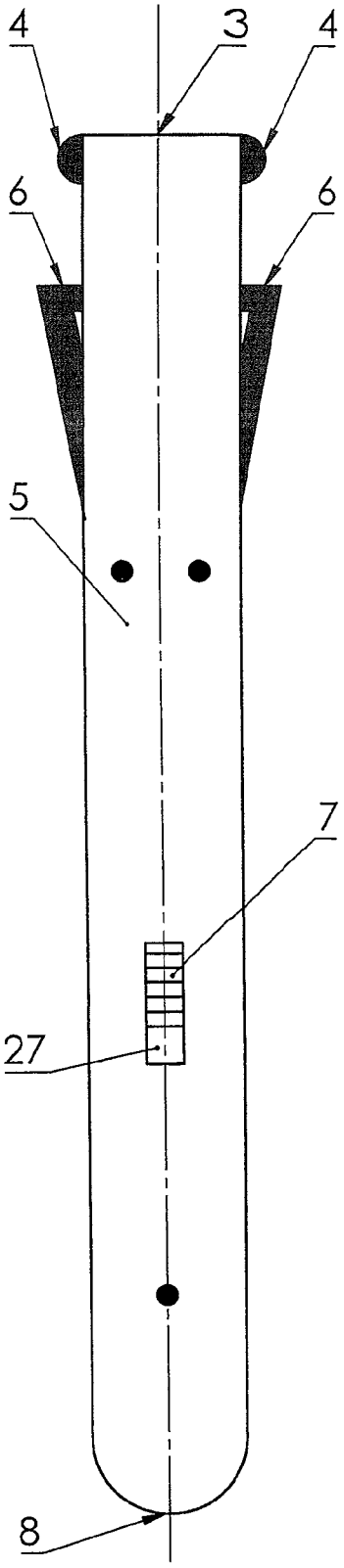
Figure 10:
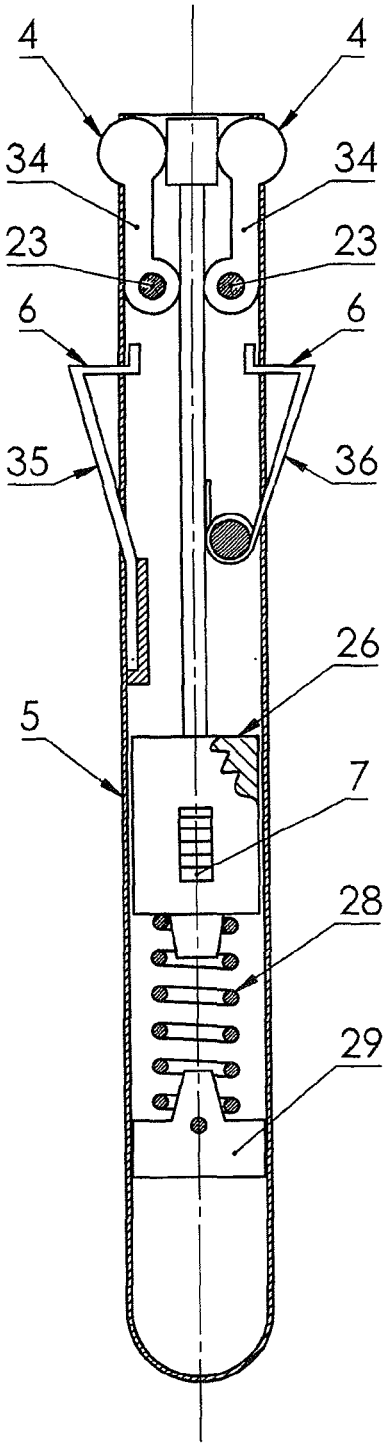
Figure 11:
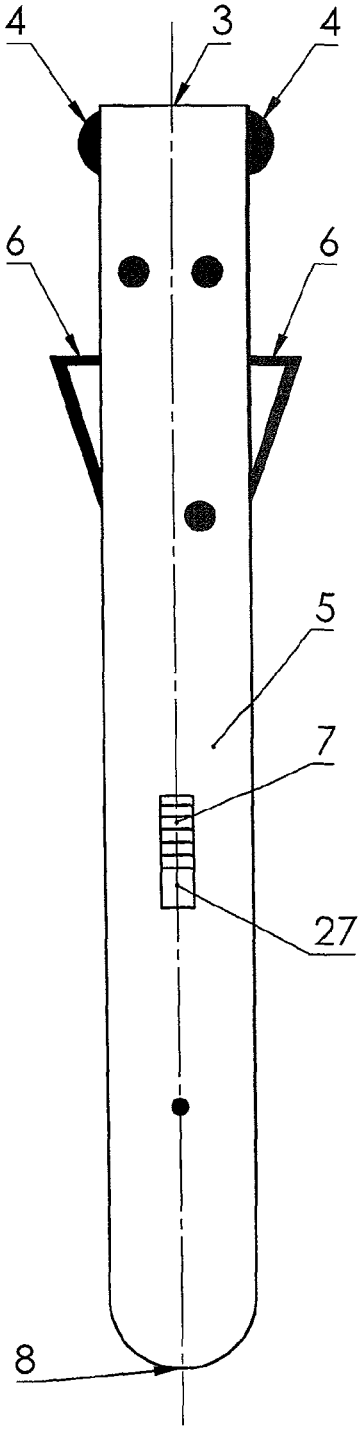
Figure 12:
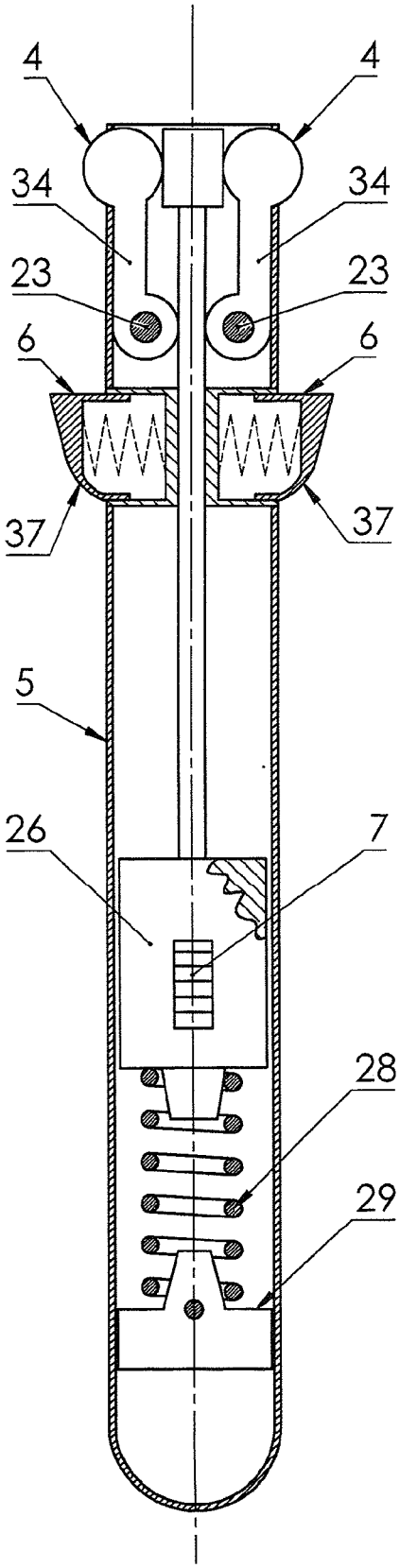
Figure 13:
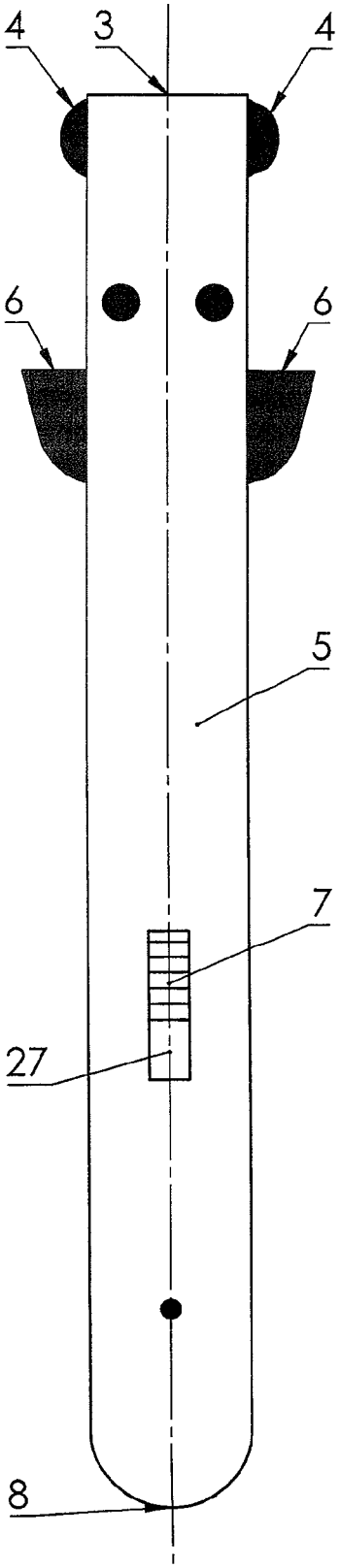
Figure 14:
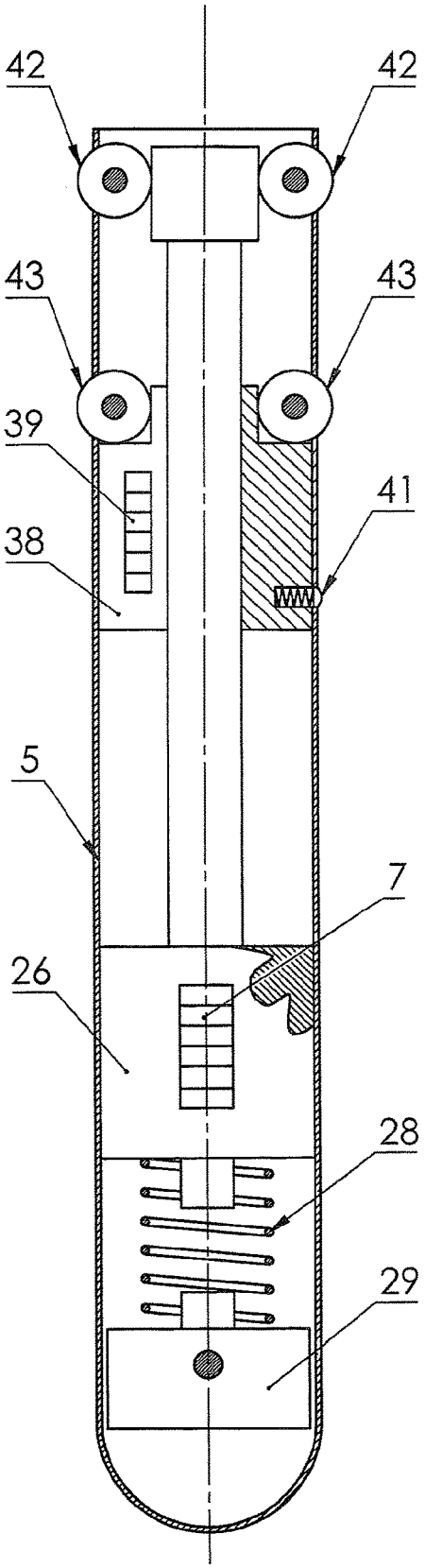
Figure 15:
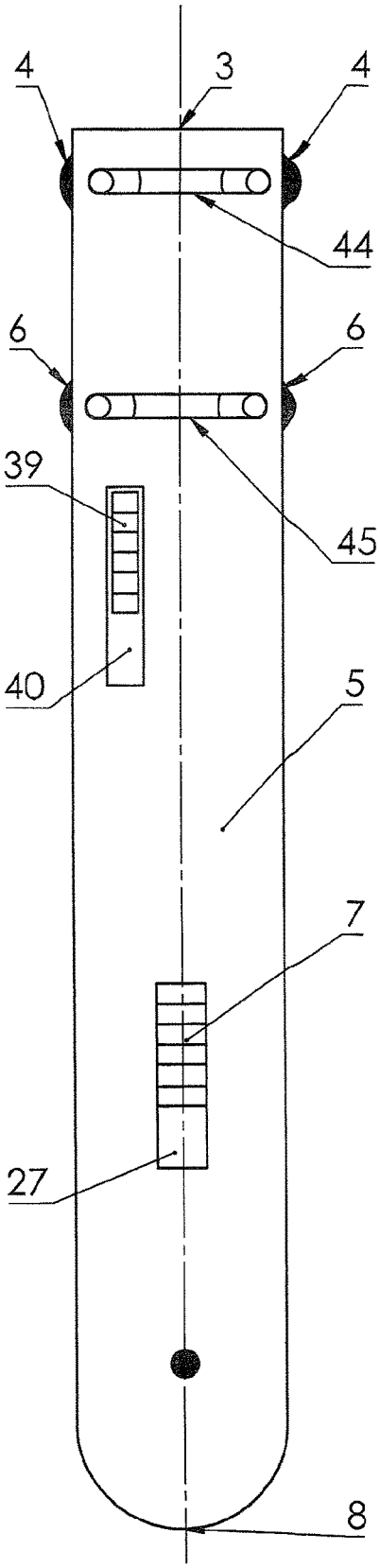
Figure 16:
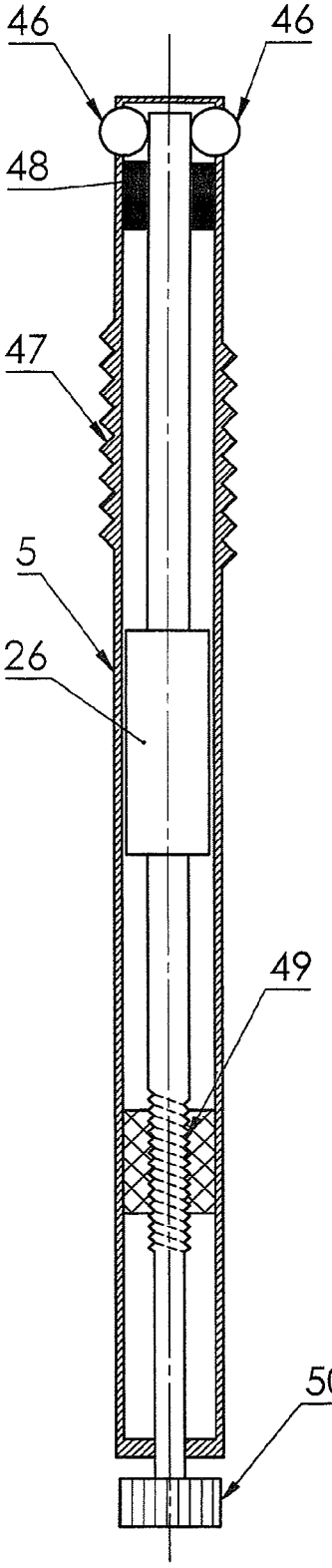
Figure 17:
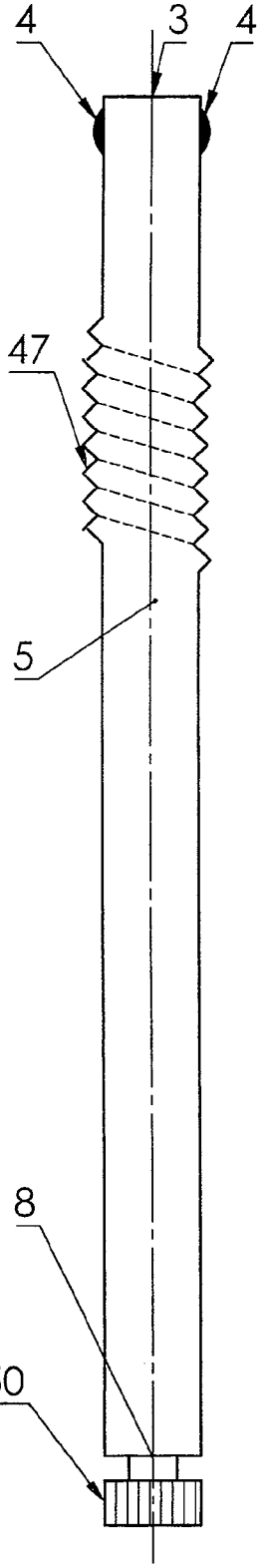
Figure 18:
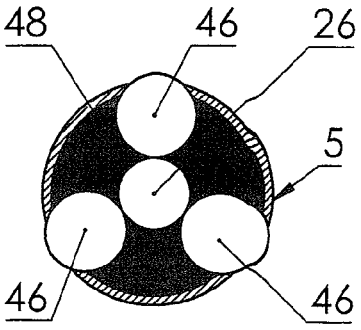
Figure 19:
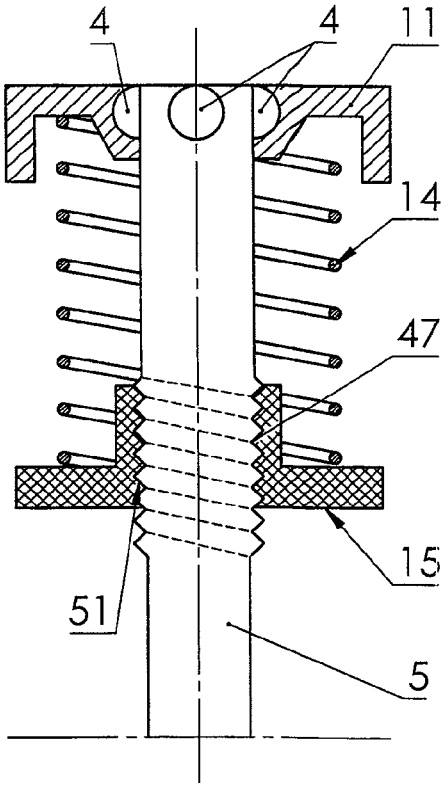
Figure 20:
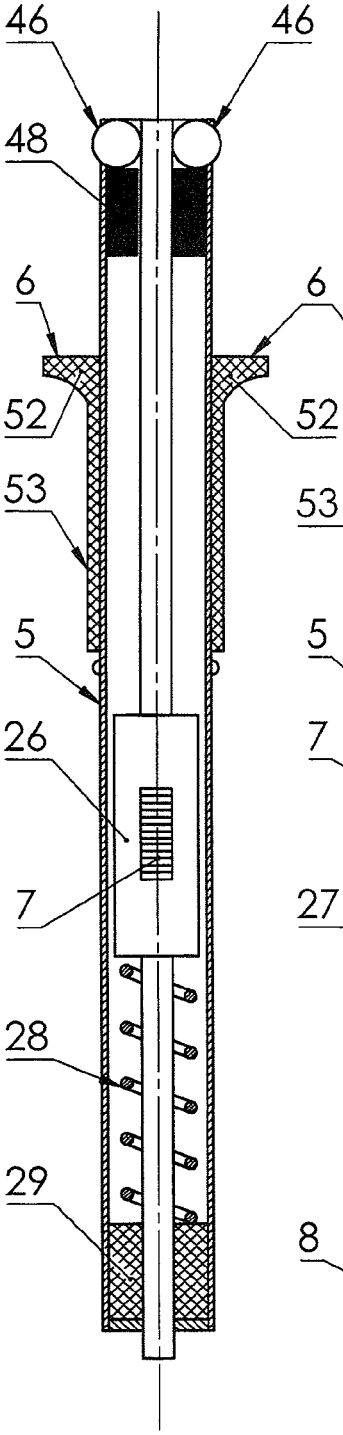
Figure 21:
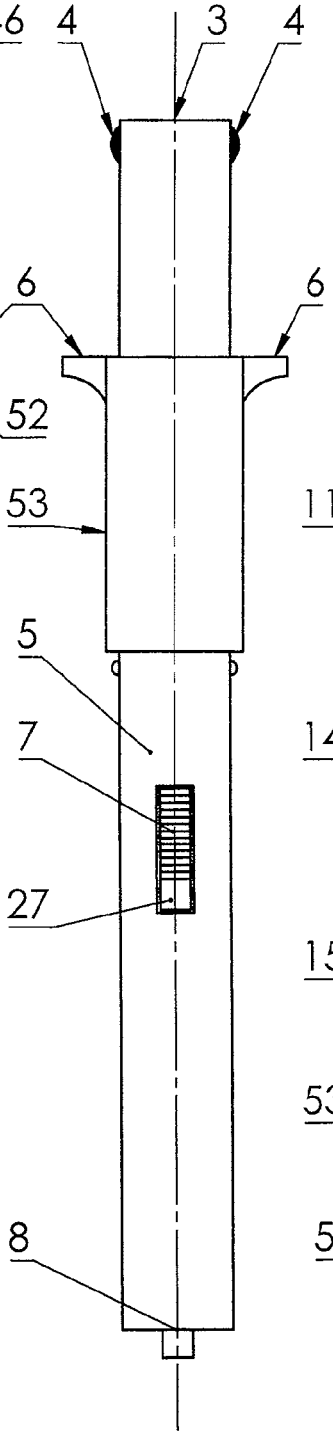
Figure 22:
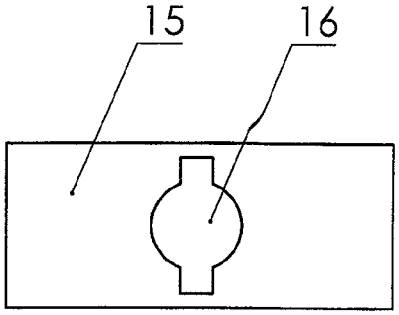
Figure 23:
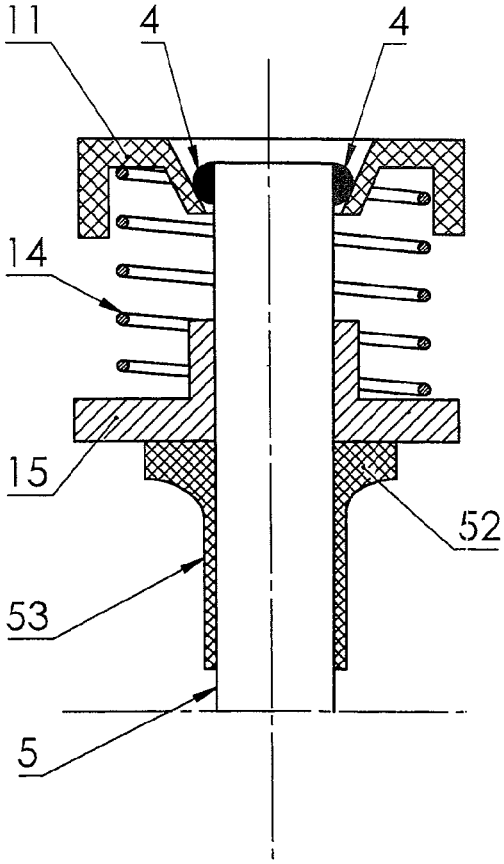
Figure 32:
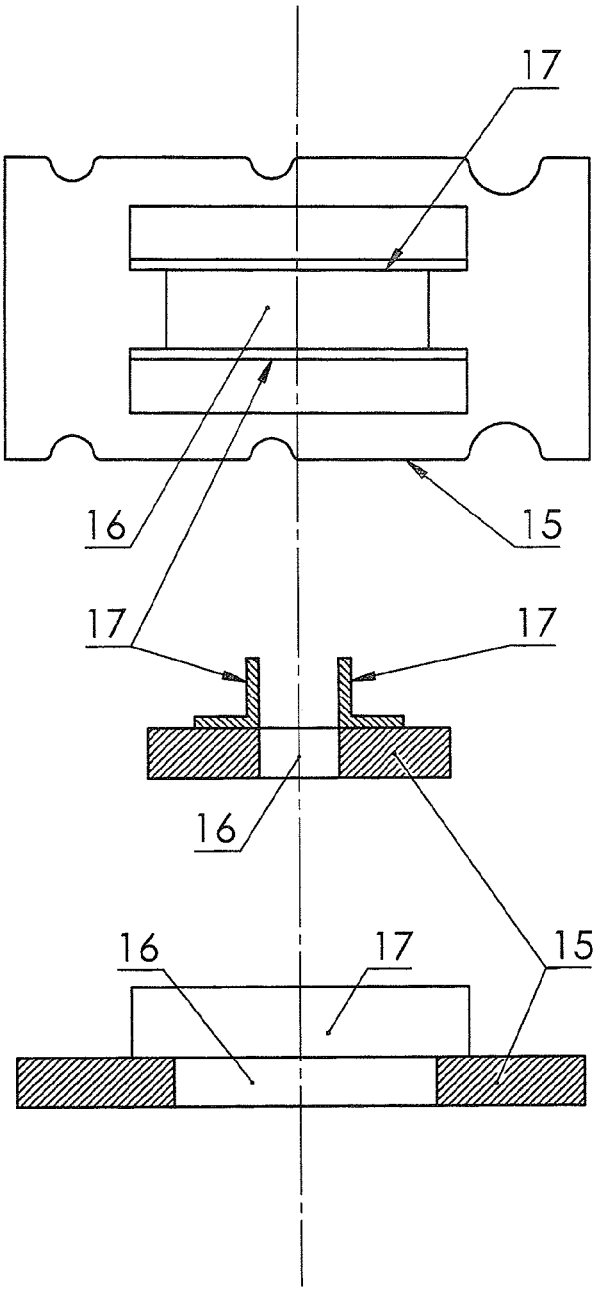
Figure 33:
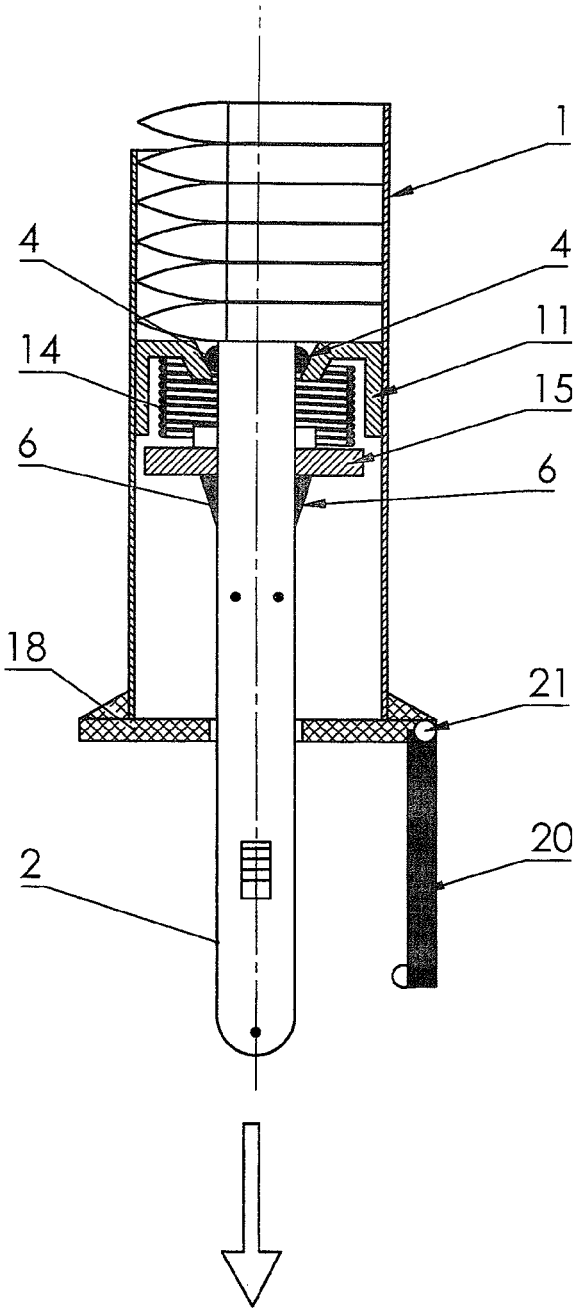

The object of the invention, in an exemplary but not exhaustive embodiment, is shown in the diagrams in the drawing, where:

FIG. 1 shows a view of the unit components, wherein FIG. 1*a* shows a general view of the magazine, FIG. 1*b* shows a general view of the pull-rod device, FIG. 1*c* shows a front view of the pull-rod device, FIG. 2*a* shows a cross-sectional layout of the magazine components, FIG. 2*b* shows a top view of the bottom plate, FIG. 2*c* shows a top view of the base cover, FIG. 3 shows the respective phases of operation of the unit, with the arrow indicating the direction of movement of the pull-rod device inside the magazine housing, FIG. 4 shows the coupling mechanism, where the movable element blocking the coils of the follower spring from below is the bottom plate, FIG. 5 shows the coupling mechanism, where the movable element blocking the coils of the follower spring from below is the extreme, lowest coil of the follower spring, FIG. 6 shows an axonometric view of the coupling mechanism, where the movable element blocking the coils of the follower spring from below is an element permanently connected to the follower spring, FIG. 7 shows a diagram of the cooperation of mechanisms in the final phase of the unit's operation, FIG. 8 shows a cross-section of the pull-rod device in a first embodiment, FIG. 9 shows a view of the pull-rod device in the first embodiment, FIG. 10 shows a cross-section of the pull-rod device in a second embodiment, FIG. 11 shows a view of the pull-rod device in the second embodiment, FIG. 12 shows a cross-section of the pull-rod device in a third embodiment, FIG. 13 shows a view of the pull-rod device in the third embodiment, FIG. 14 shows a cross-section of the pull-rod device in a fourth embodiment, FIG. 15 shows a view of the pull-rod device in the fourth embodiment, FIG. 16 shows a cross-section of the pull-rod device in a fifth embodiment, FIG. 17 shows a view of the pull-rod device in the fifth embodiment, FIG. 18 shows the fifth embodiment in a cross-section in a plane passing through the balls, FIG. 19 shows the connection of the pull-rod device to the hole of the bottom plate via a threaded connection, FIG. 20 shows a cross-section of the pull-rod device in a sixth embodiment, FIG. 21 shows a view of the pull-rod device in the sixth embodiment, FIG. 22 shows a top view of the bottom plate cooperating with the sixth embodiment of the pull-rod device, FIG. 23 shows the connection of the sixth embodiment of the pull-rod device to the bottom plate, where the transverse arms of the rotary sleeve are retained by the bottom plate, FIG. 24 shows a cross-section of the pull-rod device in a seventh embodiment, FIG. 25 shows a view of the pull-rod device in the seventh embodiment, FIG. 26 shows a top view of the bottom plate cooperating with the seventh embodiment of the pull-rod device, FIG. 27 shows the principle of cooperation between the seventh embodiment of the pull-rod device and the follower ball, FIG. 28 shows a cross-section of the pull-rod device in an eight embodiment, FIG. 29 shows a view of the pull-rod device in the eight embodiment, FIG. 30 shows a top view of the bottom plate cooperating with the eight embodiment of the pull-rod device, FIG. 31 shows the mutual positioning of the components of the eighth embodiment of the pull-rod device in relation to the follower with the ball and to its spring, FIG. 32 shows a top view, a cross-section and a longitudinal section of the magazine bottom plate, FIG. 33 shows the mutual positioning of the components of the unit for loading ammunition into box magazines at the stage of loading ammunition.

The unit for loading ammunition into box magazines of small arms, as shown in FIG. 1, is a magazine 1 (FIG. 1*a*) with a pull-rod device 2 shown from the side (FIG. 1*b*), and from the front (FIG. 1*c*). On the body 5 of the pull-rod device 2, in the zone of its upper extremity 3, there are catch protrusions 4 below which there are retention protrusions 6. On the body 5 of the pull-rod device 2, there is a control button 7. The pull-rod device 2 has a lower end 8.

The magazine 1 (FIG. 2) has a housing 9 which has a cartridge hatch 10 in its upper zone. Furthermore, the magazine 1 has a follower 11 in which a hole 12 of the follower 11 is located. The follower 11 rests on a spring 14 of the follower 11 which rests with its lower end on a bottom plate 15 (FIG. 2*b*) which has a hole 16 of the bottom plate 15 and has vertical stabilizing planes 17 on its surface. The housing 9 is closed from below by a base cover 18 having a hole 19 (FIG. 2*c*) which is closed by a swinging plate 20 which is seated on an axis 21.

FIG. 3 shows the respective phases of operation of the unit for loading ammunition. In the initial phase (FIG. 3*a*), the pull-rod device 2 is introduced into the housing 9. In the next step (FIG. 3*b*), the pull-rod device 2 pulls down the follower 11 while compressing the spring 14 of the follower 11. FIG. 3*c* shows how, once the coils of the compressed spring 14 are blocked by the retention protrusions 6, a coupling mechanism is formed. FIG. 3*d* shows the phase when the coupling mechanism (FIG. 4) has been moved into the zone of the cartridge hatch 10. FIG. 3*a* shows the phase of loading ammunition into the magazine 1 where the cartridges move the coupling mechanism (FIG. 4) downwards, and FIG. 3*f* shows the magazine 1 after loading, when the pull-rod device 2 has been slid out of the housing of the magazine 1. The coupling mechanism, where the movable element blocking the coils of the spring 14 of the follower 11 from below is the bottom plate 15, is constituted by the follower 11, the spring 14 of the follower 11, the bottom plate 15 and the pull-rod device 2, as shown in FIG. 4.

The coupling mechanism, where the movable element blocking the coils of the spring 14 of the follower 11 from below is the extreme, lowest coil 13 of the spring 14 of the follower 11, is constituted by the follower 11, the spring 14 of the follower 11 and the pull-rod device 2, as shown in FIG. 5.

The coupling mechanism, where the movable element blocking the coils of the spring 14 of the follower 11 from below is an element 59 permanently connected to the spring 14 of the follower 11, is constituted by the follower 11, the spring 14 of the follower 11, the element 59 permanently connected to the spring 14 of the follower 11 and the pull-rod device 2, as shown in FIG. 6.

FIG. 7 shows the cooperation of the unit components in the final phase of operation of the coupling mechanism. FIG. 7*a* shows the phase where, when magazine 1 is fully loaded, the cartridges block the follower 11 from above. The pull-rod device 2 is located inside the magazine 1. The catch protrusions 4 protruding beyond the outline of the body 5 are in contact with the surface of the follower 11. The compressed spring 14 of the follower 11 rests on the bottom plate 15 which rests on the base cover 18. The swinging plate 20 closing the hole of the base cover 19 is seated on the axis 21. In the next step, shown in FIG. 7*b*, when catch levers 22 are released and the pull-rod device 2 is pulled, the catch levers 22 rotates on axes 23 and move inside the body 5 of the pull-rod device 2. The next step is shown in FIG. 7*c*, where the upper end of the body 5 of the pull-rod device 2 moves in the holes 16 of the bottom plate 15 and in the hole 19 of the base cover 18. The end of the unit operation is shown in FIG. 7*d*, where the pull-rod device 2 has been slid out of the housing 9. Under the action of the expanding spring, the retention protrusions 6 protrude beyond the contour of the body 5 of the pull-rod device 2.

In the first embodiment, shown in cross-section through the pull-rod device 2 in FIG. 8, the catch protrusions 4 are in the form of double-arm levers 22 mounted on the axes 23 in the body 5. Their lower arms 24 are located in a retaining recess 25 of an upper edge of a slider 26. The steel slider 26 has a control button 7 and is pressed by a spring 28 of the slider 26 which is mounted in a seat 29 of the spring 28 of the slider 26 which is located inside the body 5 of the pull-rod device 2. The retention protrusions 6 are in the form of a single-arm lever 30 and a double-arm lever 31 which rotate on the axes 23 and are supported by an expanding spring 33. The lower arm of the double-arm lever 31 is blocked by a pin 32 mounted in the body 5 of the pull-rod device 2.

FIG. 9 shows a view of the first embodiment, where the body 5 has the upper end 3, and in the zone of the latter, there are the catch protrusions 4 protruding beyond the contour of the body 5, and below them, there are the retention protrusions 6. Furthermore, in the body 5, there is a cut-out 27 in which the control button 7 moves. The lower end 8 limits the pull-rod device 2 from below.

In the second embodiment (FIG. 10), in the body 5, there are the catch protrusions in the form of single-arm levers 34 mounted on the axes 23. Below, there are the retention protrusions 6 in the form of a fiat spring 35 and a torsion spring 36. The slider 26, in the zone of its upper extremity, is in contact with the surfaces of the single-arm catch levers 34 and has the control button 7 which is pressed by the spring 28 of the slider which is mounted in the seat 29 of the spring 28 of the slider 26. In the second embodiment (FIG. 11), the body 5 has the upper end 3 and the lower end 8, furthermore, the catch protrusions 4 and the retention protrusions 6, located below the former, protrude beyond the outline of the body 5. In the cut-out 27 of the body 5, the control button 7 moves.

In the third embodiment (FIG. 12), in the body 5, the catch protrusions 4 are mounted in the form of single-arm levers 34 mounted on the axes 23. Below, there are the retention protrusions 6 in the form of a latching mechanism 37 which, when pressed by a spring integrated therewith, moves slidably along guides in the body 5 of the pull-rod device 2. The control button 7 is located on the slider 26, and its extreme part is located between the single-arm levers 34. The slider 26 is pressed, from below, by the spring 28 of the slider 26, mounted in the seat 29. In the third embodiment (FIG. 13), the body 5 has the upper end 3 and the catch protrusions 4 located in the zone of the former, and below them, there are the retention protrusions 6, furthermore, on the body 5, there is the cut-out 27 in which the control button 7 moves. The lower end 8 limits the body 5 from below.

In the fourth embodiment (FIGS. 14 and 15), the catch protrusions 4 are in the form of discs 42 with rotation axes, moving in upper guides 44 of the body 5, and the retention protrusions 6 located below are in the form of discs 43 with rotation axes and move in lower guides 45 of the body 5. A slider 38 of the retention discs 43 has a button 39 and a blocking device 41. Furthermore, in the body 5, there is the slider 26 which is located with its upper extremity between the catch discs 42 and has the control button 7. The body 5 has the upper end 3 in the zone of which there are the catch protrusions 4 and the upper guides 44. Below, there are the retention protrusions 6 moving in the lower guides 45. In an upper cut-out 40 of the body 5, the button 39 of the retention slider 38 moves. In the cut-out 27 of the body 5, the control button 7 moves.

In the fifth embodiment (FIGS. 16, 17, 18 and 19) in the body 5, in the zone of the upper extremity, there are the catch protrusions 4 in the form of steel balls 46 resting on the upper surface of an inner ring 48 located in the body 5. The outer surface of the body 5 has a thread 47 which connects to a thread 51 of the hole of the bottom plate 15. Inside, the body 5 has the slider 26 which is located with its upper extremity between the steel balls 46. In the lower zone of the body 5, the slider 26 has a thread 49 which connects to an internal thread of the body 5 and is controlled by a rotary handle 50 protruding from the body 5 of the pull-rod device 2. In the zone of the upper end 3, the body 5 has the catch protrusions 4, below, on the outer surface, the body 5 has the thread 47, and below the lower end 8 of the body 5, there is the rotary handle 50. FIG. 18 shows the fifth embodiment of the pull-rod device 2 in the zone of the upper extremity of the body 5 in a cross-section, where the steel balls 46, resting on the surface of the inner ring 48, are retained by the extreme portion of the slider 26. The whole is enclosed by the body 5. FIG. 19 shows the pull-rod device of the fifth embodiment with the bottom plate 15 having the thread 51 in its hole. The catch protrusions 4 are retained by the follower 11, and the compressed spring 14 of the follower 11 is closed by the bottom plate 15 which is connected with the thread in the hole 16 of the bottom plate 15 to the external thread 47 of the body 5 of the pull-rod device 2.

In the sixth embodiment of the pull-rod device, shown in a cross-section in FIG. 20, in the upper zone of the body 5, the catch protrusions 4 are in the form of the steel balls 46 and rest on the upper surface of the inner ring 48. Inside the body 5 of the pull-rod device 2, there is the slider 26, the upper extremity of which is located between the steel balls 46, and in the zone of its lower end it is supported by the spring 28 of the slider 26, mounted in the seat 29 of the spring 28 of the slider 26, and has the control button 7. On the outer surface of the body 5 of the pull-rod device 2, a rotary sleeve 53 is mounted, having opposite arms 52 which are the retention protrusions 6. The view of the pull-rod device 2 of the sixth embodiment shown in FIG. 21 shows the body 5, where at its upper end 3, there are the catch protrusions 4 and, below, the retention protrusions 6 which are part of the rotary sleeve 53 which is rotatably mounted on the outer surface of the body 5 of the pull-rod device 2. In the cut-out 27 of the body 5, the control button 7 moves. The lower end 8 limits the body 5 from below. With the sixth embodiment (FIG. 22), the bottom plate 15 cooperates, which has the shaped hole 16 to allow the pull-rod device 2, having opposite arms 52 which are part of the rotary sleeve 53, to move into the housing 9 of the magazine 1. The connection of the pull-rod device 2 of the sixth embodiment to the bottom plate is shown in FIG. 23, where the follower 11 is pulled by the catch protrusions 4, and the compressed spring 14 of the follower 11 rests on the bottom plate 15 which retains the opposite arms 52 of the rotary sleeve 53.

A cross-section of the next, seventh embodiment of the pull-rod device is shown in FIG. 24, where in the body 5, there are double-arm catch levers 22 mounted on the axes 23 and supported by an expanding spring 56, and are retained with their lower arms 24 by lateral surfaces 60 of the slider 26 which has the control button 7 and is pressed by the spring 28 of the slider 26 mounted in the seat 29. The retention protrusions 6 are in the form of stationary symmetrical surfaces 61 permanently connected to the body 5 of the pull-rod device 2. At the extremities of the double-arm levers 22, there are the catch protrusions 4. In the view in FIG. 25, the catch protrusions 4 protrude beyond the upper end 3 of the body 5. The body 5 of the pull-rod device 2 has symmetrical, transverse surfaces forming the retention protrusions 6. Below, in the body 5, there is the cut-out 27 in which the control button 7 moves. The lower end 8 of the body 5 limits the pull-rod device 2 from below.

In this embodiment (FIG. 26), the bottom plate 15 has the shaped hole 16 with an outline similar to the letter "T".

Components of the connection of the pull-rod device 2 with the follower 11 in this embodiment are shown in FIG. 27. On its undersurface, the follower 11 has a ball 55 seated on a pin 54, on which the catch levers 22 are caught The compressed spring 14 of the follower 11 is closed by the bottom plate 15 which retains the retention surfaces of the body 5 of the pull-rod device 2.

The eighth embodiment is shown in a cross-section in FIG. 28. In the body 5, on the axes 23, two double-arm levers 22 are mounted, protruding beyond the upper end 3 of the body 5 and directed with the catch protrusions 4 inwards. The lower arms 24 of the lever 22 are retained by the lateral surfaces 60 of the slider 26 and are supported by the expanding spring 56. The slider 26 has the control button 7 and is supported by the spring 28 of the slider 26 which is mounted in the seat 29. In the upper zone of the body 5, between the arms of the double-arm levers 22, there is a hole 57, the lower edge 58 of which retains the surface of the bottom plate 15.

Shown in FIG. 29, the eighth embodiment has the catch protrusions 4 located above the upper end 3 of the body 5, and in the upper zone of the body 5, there is the hole 57 the lower edge 58 of which is a retention surface for the bottom plate 15. In the cut-out 27 of the body 5, there is the control button 7.

In this embodiment (FIG. 30), the bottom plate 15 has the shaped hole 16 with an outline similar to the letter "C".

The connection between the pull-rod device 2 and the follower 11 having on its lower surface the pin 54 with the ball 55 in the eighth embodiment is shown in FIG. 31. The pin 54 with the ball 55 is connected to the follower 11. The body 5 of the pull-rod device 2 with the hole 57 moves inside the coils of the spring 14 of the follower 11.

The bottom plate 15 in a top view and its cross-section and longitudinal section relative to its main surface are shown in FIG. 32. The bottom plate 15 has stabilizing surfaces 17 vertical to its main surface, between which there is the hole 16 of the bottom plate 15.

The magazine (FIG. 33) has the pull-rod device 2 slid in, which connects to the follower 11 via the catch protrusions 4. The retention protrusions 6 block the bottom plate 15 and thereby close the compressed spring 14 of the follower 11 from below. The lower end of the pull-rod device 2 protrudes from the base cover 18 which has a closing swinging plate 20 seated on the rotation axis 21.

In order to activate the unit, the pull-rod device 2 needs to be connected to the magazine 1.

To start loading ammunition into the magazine in the first embodiment of the pull-rod device 2, (FIG. 8), the plate 20 closing the hole of the base cover is tilted downwards, then the pull-rod device 2 is slid through the cartridge hatch 10 into the housing 9 of the magazine 1 so that it passes the hole 12 of the follower 11, the hole 16 of the bottom plate 15 and the hole 19 of the base cover 18 and rests with the catch protrusions 4 on the surface of the follower 11, with the lower part of the pull-rod device 2 protruding beyond the base cover 18 of the magazine 1. The protruding part of the body 5 is then pulled to displace the follower 11 downwards while compressing the spring 14 of the follower 11. When slid through the hole 16 of the bottom plate 15 and under the action of the expanding spring 33, the retention protrusions 6 move and then are retained by the surface of the bottom plate 15 and block the spring 14 of the follower 11 from below. The coupling mechanism thus formed (FIG. 4) allows, by sliding the part of the body 5 of the pull-rod device 2 which protrudes from the housing 9 of the magazine 1, to move the compressed spring 14 of the follower 11 into the zone of the cartridge hatch 10. The process of loading ammunition into the magazine 1 takes place. Successive cartridges, slidable into the magazine 1, push the coupling mechanism (FIG. 4) downwards. When the magazine is fully loaded, the follower 11 and the compressed spring 14 of the follower 11 will be blocked from above by the cartridges contained in the magazine 1. Once the loading process is complete, the control button 7 is slid downwards, causing the slider 26 to move downwards and unblock the lower arms of the double-arm catch levers 24 which then perform a rotation about their own axes 23 and the catch protrusions 4 move into the body 5 of the pull-rod device 2. Once these operations are complete, the pull-rod device 2 is slid out of the housing 9 and the control button 7 is released, which causes the slider 26, under the action of the spring 28 of the slider 26, to move upwards and again block the lower arms of the double-arm catch levers 24 which are again located in the shaped retaining recess 25 of its upper edge, which makes the pull-rod device 2 ready to cooperate with the magazine 1 again. Loading in the second and third embodiments is performed by carrying out the steps as in the first embodiment.

Loading the magazine with the solution shown in the fourth embodiment (FIG. 14): the plate 20 closing the hole 19 of the base cover 18 is tilted downwards. In turn, the retention slider button 39 is slid downwards. The pull-rod device 2 is then slid into the housing 9 through the cartridge hatch 10 to pull its lower part to the stop. Next, the retention slider button 39 is slid upwards, which causes the retention discs 43 to be slid under the surface of the bottom plate 15 and the latter to be blocked, after which the coupling mechanism is slid into the zone of the cartridge hatch 10 and the loading of ammunition into the magazine begins. Once ammunition is loaded, the control button 7 is slid downwards and the body 5 of the pull-rod device 2 is slid, which will cause the catch discs 42 to move into the body 5 of the pull-rod device 2, thus allowing the pull-rod device 2 to be slid out of the housing 9 of the magazine 1. When loading the magazine 1 with the solution according to the fifth embodiment (FIG. 16), the pull-rod device 2 is slid in through the cartridge hatch 10 so that the catch surfaces of the steel balls 46 rest on the surfaces of the follower 11, and then the body 5 is pulled down to the stop. In turn, the body 5 of the pull-rod device 2 is rotated around its longitudinal axis so that the external thread 47 of the body 5 of the pull-rod device 2 is connected to the bottom plate hole thread 51 of the magazine 1. The coupling mechanism formed by these actions moves to the vicinity of the cartridge hatch 10. The magazine 1 is prepared to load cartridges. Once the cartridges are loaded, the rotary handle 50 unblocks the steel balls 46 to move them into the body 5, after which the body 5 of the pull-rod device 2 is disconnected from the bottom plate 15 by unscrewing the body 5 of the pull-rod device 2 from the thread 51 of the bottom plate hole 16 and the pull-rod device 2 is removed from the housing 9 of the magazine 1.

To load the magazine 1 with the pull-rod device 2 in the sixth embodiment (FIG. 20), the pull-rod device 2 is slid into the housing 9 of the magazine 1 through the shaped hole 16 of the bottom plate 15 and slid towards the follower 11. Then, the control button 7 is slid and the upper end 3 of the body 5 is placed in the hole of the follower 11 and the control button 7 is released so that the retention protrusions 4 catch on the surfaces of the follower 11. Thereafter, the body 5 of the pull-rod device 2 is moved so that the alternating arms 52 of the sleeve 53 come into contact with the surface of the bottom plate 15, after which the rotary sleeve 53 is rotated so that the arms 52 move through the hole of the bottom plate 15 and the sleeve 53 is rotated again to rest the arms of the sleeve 52 on the surface of the bottom plate 15 and move the coupling mechanism to the zone of the cartridge hatch 10, and start the loading of ammunition. Once the magazine is loaded, the control button 7 is moved downwards and the pull-rod device 2 is removed from the housing 9 of the magazine 1.

In the seventh embodiment of the pull-rod device 2 (FIG. 24), in order to load the magazine 1, the plate 20 closing the hole 19 of the base cover 18 is tilted, and through this hole and the hole 16 of the bottom plate 15, the pull-rod device 2 is slid in, moving the upper end 3 of the body 5 to the vicinity of the ball 55 of the follower 11. When the control button 7, and together with it the slider 26, is moved, the lower arms 24 of the double-arm catch levers 22 are unblocked. The catch protrusions 4 catch on the ball 55 of the follower 11, after which the control button 7 is released, which again blocks the double-arm catch levers 22. In turn, the body 5 of the pull-rod device 2 is moved downwards so that the retaining surfaces 61 of the body 5 of the pull-rod device 2 slide under the surface of the bottom plate 15, and the coupling mechanism formed by these actions (FIG. 4) slides into the zone of the cartridge hatch 10. The magazine 1 is prepared to load ammunition. Once the loading is complete, the control button 7 is slid to unblock the catch protrusions 4, previously latched against the ball 55 of the follower 11, and the pull-rod device 2 is removed from the housing 9 of the magazine 1.

In the eighth embodiment (FIG. 28), in order to load the magazine 1, the actions as in the seventh embodiment are carried out, with the lower surface of the bottom plate 15 being blocked by the lower edge 58 of the retention hole 57 of the body 5 of the pull-rod device 2.

The invention claimed is:

1. A unit for loading ammunition into small arm box magazines which is constituted by a pull-rod device and a magazine having a housing with an upper slot for moving ammunition below which a follower with a centrally located hole is located, wherein the follower is seated on a spring which rests with its lower end on a bottom plate having a centrally located hole and rests on a base cover having a central hole, wherein the rigid pull-rod device, slidable into the housing, is located in the hole of the follower, the hole of the bottom plate and the hole of the base cover and has movable catch protrusions preferably located in the zone of the upper extremity of the body, protruding beyond the outline of the body, detachably connected to the surface of the follower, closing the spring of the follower from above and controlled by a slider operated by a spring, the seat of which is located inside the body, and retention protrusions located below the catch protrusions in the zone of the upper extremity of the body, wherein the retention protrusions, after compression of the spring of the follower, are retained by a movable element blocking the coils of the spring of the follower from below, thereby they close the compressed spring of the follower from below and co-create a preferable coupling mechanism that moves along the longitudinal axis of the magazine, and the height of the compressed spring of the follower, when it is moved, is an approximately constant value, whereby the follower, the follower spring, the movable element blocking the coils of the spring of the follower from below and the pull-rod device constitute the coupling mechanism.

2. The unit according to claim 1, wherein the movable element blocking the coils of the spring of the follower from below is the bottom plate.

3. The unit according to claim 1, wherein the movable element blocking the coils of the spring of the follower from below is the extreme coil of the spring of the follower.

4. The unit according to claim 1, wherein the of the follower from below is an element permanently connected to the spring of the follower.

5. The unit according to claim 1, wherein the catch protrusions, closing the spring of the follower from above, are in the form of double-arm levers seated on axes in the body of the pull-rod device.

6. The unit according to claim 1, wherein the lower arms of the double-arm levers of the catch protrusions are located in a shaped retaining recess of the upper edge of the slider.

7. The unit according to claims 6, wherein the outline of the retaining recess has a shape similar to the letter "U".

8. The unit according to claims 6, wherein the outline of the retaining recess has a shape similar to the letter "V".

9. The unit according to claim 1, wherein the retention protrusions are in the form of single-arm levers, mounted on the axes in the body of the pull-rod device.

10. The unit according to claim 1, wherein the retention protrusions are in the form of double-arm levers, mounted on the axes in the body of the pull-rod device.

11. The unit according to claim 1, wherein the levers of the retention protrusions have an expanding spring.

12. The unit according to claim 1, wherein the catch protrusions are in the form of single-arm levers, mounted on the axes in the body of the pull-rod device.

13. The unit according to claim 1, wherein the retention protrusions are in the form of a flat spring, mounted in the body of the pull-rod device.

14. The unit according to claim 1, wherein the retention protrusions are in the form of a torsion spring, mounted in the body of the pull-rod device.

15. The unit according to claim 1, wherein the retention protrusions are in the form of a latching mechanism, moving slidably along guides in the body of the pull-rod device.

16. The unit according to claim 1, wherein the catch protrusions are in the form of discs with rotation axes located in upper guides of the body of the pull-rod device.

17. The unit according to claim 1, wherein the retention protrusions are in the form of discs with rotation axes located in lower guides of the body of the pull-rod device.

18. The unit according to claim 1, wherein a slider of the retention protrusion has a blocking device.

19. The unit according to claim 1, wherein the catch protrusions are in the form of steel balls resting on the upper surface of an inner ring of the body of the pull-rod device.

20. The unit according to claim 1, wherein the body of the pull-rod device has a circular cross-section, and the retention protrusions are in the form of a thread located on the outer surface of the body of the pull-rod device.

21. The unit according to claim 1, wherein the slider is connected to the body through a threaded connection located inside the body and has a rotary handle.

22. The unit according to claim 1, wherein the bottom plate has the hole with a thread for connection to the external thread of the body of the pull-rod device.

23. The unit according to claim 1, wherein the retention protrusions are in the form of opposite arms, permanently connected to the body of a rotary sleeve that rotates on the outer surface of the pull-rod device.

24. The unit according to claim 1, wherein the lower arms of the double-arm levers of the catch protrusions are retained by lateral surfaces of the slider.

25. The unit according to claim 1, wherein the retention protrusions are in the form of symmetrical, stationary surfaces that are transversely positioned with respect to the longitudinal axis of the body and permanently connected to the body of the pull-rod device.

26. The unit according to claim 1, wherein the follower has, on its lower surface, a pin terminated with a spherical surface for latching connection to the catch protrusions.

27. The unit according to claim 1, wherein the bottom plate has the hole with an outline similar to the letter "T".

28. The unit according to claim 1, wherein there is a hole in the upper zone of the body of the pull-rod device, the lower edge of said hole constituting a lower barrier of the pull-rod device for connection to the bottom plate and lying on the longitudinal axis of symmetry of the body of the pull-rod device.

29. The unit according to claim 1, wherein the lower arms of the double-arm catch levers have an expanding spring.

30. The unit according to claim 1, wherein the bottom plate has the hole with an outline similar to the letter "C".

31. The unit according to claim 1, wherein the slider has a control button.

32. The unit according to claims 1, wherein the control button moves in a cut-out of the body of the pull-rod device.

33. The unit according to claim 1, wherein the bottom plate has vertical stabilizing planes located opposite each other, between which the hole of the bottom plate is located.

34. The unit according to claim 1, wherein the hole of the base cover of the magazine is closed by a swinging plate seated on a rotation axis.

* * * * *